United States Patent [19]

Buxton et al.

[11] 4,193,512

[45] Mar. 18, 1980

[54] DEVICE FOR ARRANGING PLAYING ELEMENTS

[76] Inventors: Gordon D. Buxton; John W. Buxton, both of 94 Mosedale Cres., Willowdale, Ontario, Canada, M2J 3A4

[21] Appl. No.: 901,844

[22] Filed: May 1, 1978

[51] Int. Cl.[2] ..... B65G 29/02; B65G 59/06; A63H 33/00

[52] U.S. Cl. ..... 221/185; 46/1 R; 46/17; 198/480; 221/266

[58] Field of Search ..... 221/185, 186, 266; 46/1 R, 17, 134; 273/148 R, 86 R, 127 R, 127 D; 198/480; 222/623, 624

[56] References Cited

U.S. PATENT DOCUMENTS

| | | | |
|---|---|---|---|
| 156,090 | 10/1874 | Husted | 221/266 |
| 925,485 | 6/1909 | Lafler | 221/266 |
| 1,461,396 | 7/1923 | Larsen | 222/623 |
| 2,587,042 | 2/1952 | Haiselup | 46/1 R |
| 3,621,601 | 11/1971 | Greenberg | 46/1 R |

*Primary Examiner*—F. J. Bartuska
*Attorney, Agent, or Firm*—Hirons, Rogers & Scott

[57] ABSTRACT

A device for arranging playing elements such as dominoes and the like in upstanding disposition on a surface, in serial arrangement and spaced so that they will all be knocked over when the end member of the series falls over, comprises an element storage member and a wheel structure in a housing. The wheel structure consists of two axially spaced discs with peripheral notches. As the wheel structure is rolled across the surface, the elements are taken from the storage element, around the wheel while supported in the notches, and deposited on the surface at the bottom of the wheel where they are disengaged from the wheel in an upright disposition.

3 Claims, 8 Drawing Figures

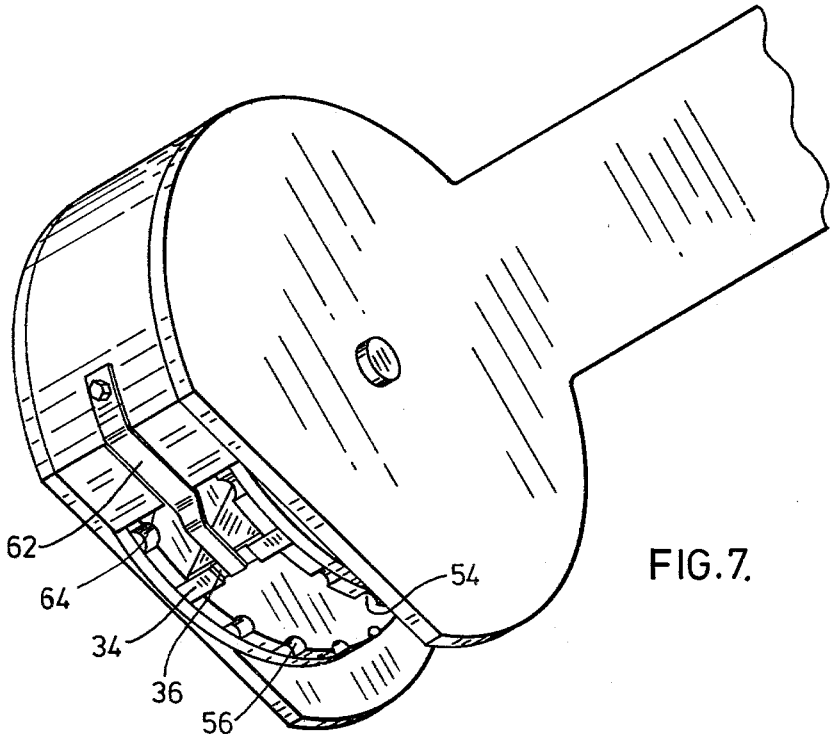
FIG. 7.
FIG. 8.
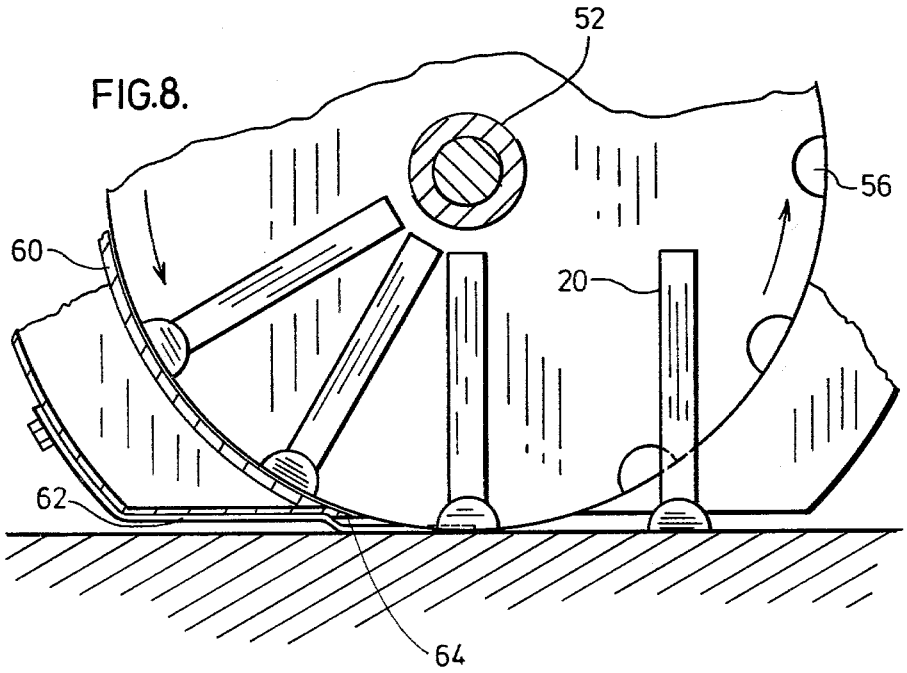

DEVICE FOR ARRANGING PLAYING ELEMENTS

FIELD OF THE INVENTION

This invention relates to amusement apparatus and playing pieces or elements associated therewith. More particularly it is concerned with an apparatus for arranging a plurality of playing pieces or elements onto a receiving surface in an upright disposition, and the playing pieces useful for the device.

BACKGROUND OF THE INVENTION

A popular diversion for many years has been the arrangement of a series of dominoes in an upright position on a flat surface, e.g., a table, in serial arrangement and appropriately spaced so that when one domino falls over towards the next, it knocks the next domino over so that the entire series topples over in sequence. Long lines, patterns and arrangements of dominoes can thus be set up in upright position, to be knocked down from one end, in sequence, in spectacular fashion. Whilst the knocking down of the sequence of dominoes may be amusing in the extreme, the setting up of the sequence, in upright position at the correct spacing, is tedious in the extreme. A single mistake or careless placement can cause the entire sequence erected to that point to collapse. Whilst dominoes are of the type of playing piece commonly used in such pastimes, any similar piece is obviously equally applicable, provided it has a narrow base on which to stand in an upright condition. Toy figurines are examples of alternatives to dominoes in such pastimes.

REVIEW OF THE PRIOR ART

U.S. Pat. No. 3,621,601 Greenberg shows a toy in which a series of domino-resembling pieces can be erected on a base to which they are movably attached, in a location so that knocking down of the end domino-like piece of the sequence causes the whole sequence to be knocked down. Means is provided on the base for re-erecting the collapsed domino-like pieces. However, this toy relates only to dominoes in association with a base to which they are affixed, not to separate domino-like elements.

U.S. Pat. No. 2,587,042 Haiselup shows a target toy in which a number of figurines, e.g., toy soldiers, are pivotally mounted on a base. When the sequence of figurines are in the erect position, the end one is used as a target, and when it is knocked over, it falls against the second of the sequence, thereby causing the whole sequence to collapse. However, this again relies upon target figures permanently pivotally mounted to a given base.

SUMMARY OF THE INVENTION

It is an object of the present invention to provide a novel amusement apparatus.

It is a further object of the present invention to provide a novel amusement apparatus which can be used to arrange domino-like playing pieces in upright disposition on a surface.

It is a further object of the present invention to provide a playing element for use with such amusement apparatus.

In accordance with the present invention, there is provided a device for arranging playing elements in an upstanding disposition on a surface, with predetermined spacings between adjacent ones of said playing elements, said device comprising:

a playing element storage means for storing therein a plurality of playing elements;

a rotatable member disposed adjacent to the storage means and rotatable with respect thereto, the rotatable member being adapted to roll across said surface;

playing piece receiving means on the rotatable member and adapted to receive a playing piece from the storage means in response to rotation of the rotatable member with respect to the storage means;

said playing piece receiving means being adapted to release the playing piece in upstanding disposition on the surface as a result of rolling of the rotable member across said surface.

According to another aspect of the present invention, there is provided a playing element for use with a device as aforesaid, said playing element having a thin, elongated body portion, first and second outwardly extending projecting formations disposed at one end of the body portion, and projecting outwardly of opposed lateral sides of said body portion, the lower surface of said outwardly extending projecting formations forming a planar base upon which the playing piece may stand in upstanding disposition, and the upper surface of each of said first and second outwardly extending projecting formations providing a shoulder formation presented towards the opposed end of said body portion, and by means of which the playing piece may be supported in an inverted, suspended position.

The device and playing piece according to the invention thus provide an amusement device by means of which playing pieces such as dominoes may be erected on a surface, in upstanding disposition, readily, simply and rapidly merely by loading the device with playing pieces in its storage means, and rolling it by hand across a receiving surface, in directions and patterns at the choice of the user, to produce lines and sequences of upstanding playing pieces ready for pushing over in amusing and diverting fashion. The device avoids tedious arrangement of individual playing pieces in a row, and places them a predetermined distance from each other so that they may be readily collapsed from one end. The device can be hand held and advanced on the receiving surface by means of the rotatable member rolling by friction across the receiving surface.

DESCRIPTION OF THE PREFERRED EMBODIMENTS

Preferably the device according to the invention is a hand operated device having an elongated storage means in the form of a magazine in which the playing pieces are loaded, the rotatable member being at one end of the magazine and a handle being provided at the other, by means of which the device can be supported and pushed across the surface. The rotatable member is suitably a wheel, journalled in side frame members so that its perimeter is adjacent to the end of the magazine. The perimeter of the wheel extends below the edge of the side frame members so that the device rests on the wheel perimeter on the surface. When pushed, the wheel rotates in the frame, relative to the storage means.

In the preferred embodiment of the invention, the playing pieces are stored in inverted manner in the storage means. In the operating position, the storage means slopes downwardly in the direction of the wheel, so that the playing pieces are fed successively to the vicinity of the wheel under gravity. The wheel is preferably in the form of a pair of parallel discs, separated by a space wide enough to receive therein the body of the playing piece. The playing piece receiving means are preferably pairs of shallow recesses, one on the perimeter of each of the discs of the wheel and in registry with one another. These recesses receive therein the first and second outwardly extending projecting formations on the playing pieces, receiving the upwardly presented surfaces thereof so as to support the playing pieces in inverted position. As the wheel rolls across the surface, the playing pieces go around with the wheel, being radially disposed therein, until they are released from the recesses in their upstanding position, and deposited on the surface. Due to the spacing between the discs of the wheel and the side frame members in which the wheel is journalled, the wheel can be pushed away from the deposited, upstanding playing pieces, without interfering with them.

A particularly preferred embodiment of the device according to the invention has its storage means or magazine in the form of an elongated open channel, provided with upper side ledges on each side thereof, the width of the channel being sufficient to receive the width of the body portions of the playing pieces, whilst the ledges thereon support the playing pieces in inverted position, by engagement of the upwardly presented surfaces of the projecting formations.

A device according to the invention is simple and economical to manufacture, and simple and pleasing to operate. It can be designed to handle large numbers of playing pieces at a single loading, and can be made light, simple and transportable, and of pleasing appearance and operation.

DESCRIPTION OF THE DRAWINGS

FIG. 7 is a perspective view of part of the device in accordance with FIG. 1 from underneath;

FIG. 8 is a cross section of a detail of the device, illustrating the positioning of the playing elements in serial arrangement onto to a receiving surface.

DESCRIPTION OF THE SPECIFIC PREFERRED EMBODIMENT

Figure 1:
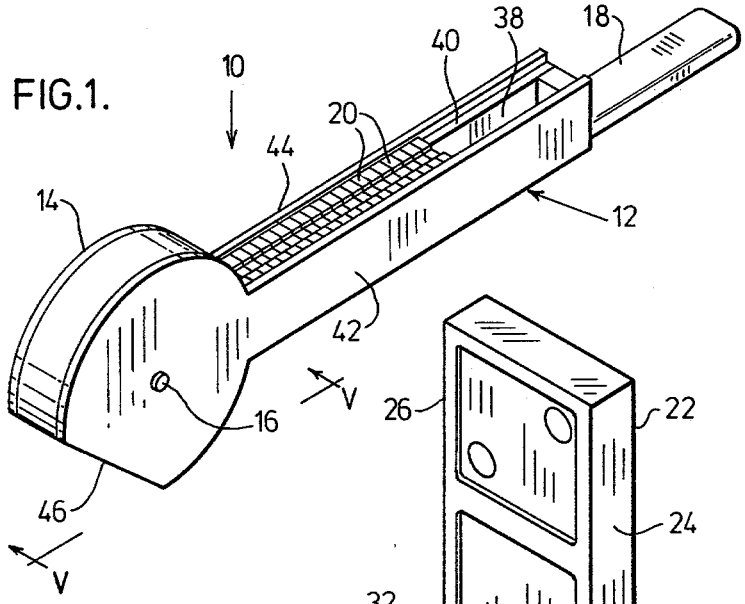
FIG. 1 is a perspective view of a device in accordance with a specific preferred embodiment of the present invention.

The amusement apparatus 10 shown in FIG. 1 generally comprises an elongated playing element storage means or magazine 12 and a rotatable member in the form of a disc wheel, mounted at one end of the storage means 12, between part circular frame members defining housing 14 in which the wheel is journalled on a central pivot pin 16. At the end of the magazine 12 remote from the wheel housing 14 is a handle 18. As shown in FIG. 1, prior to operation, the magazine 12 is loaded with playing pieces 20.

Figure 2:
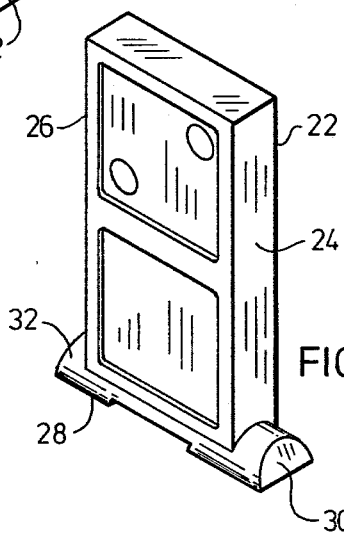
FIG. 2 is a perspective view an embodiment of a playing element for use with the device shown in FIG. 1.
Figure 3:
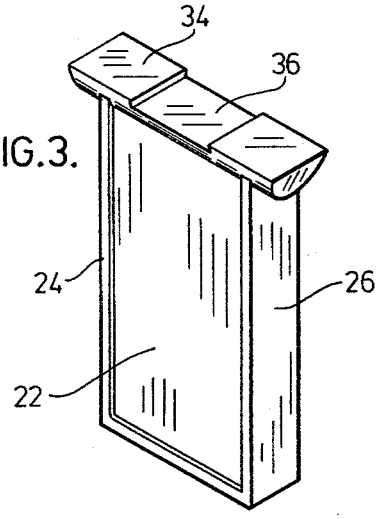
FIG. 3 is a perspective view of the playing element of FIG. 2 in an inverted position.

A playing piece is shown in detail in FIGS. 2 and 3. In this embodiment, the playing piece is a specially modified domino, having a thin elongated rectangular body portion 22 with a pair of parallel upstanding side edges 24, 26. At one end, the playing piece is provided with a base 28 with first and second outwardly extending projecting formations 30, 32 which extend laterally outwardly of the respective side edges 24, 26. The top surfaces of the projecting formations 30, 32, presented upwardly when the playing piece is upright as shown in FIG. 2, are curved, part circular. The bottom surface 34 of the base 28 is generally flat, so that the playing piece may stand on it in upright condition, but is provided with a recess 36 in the center portion.

Figure 6:
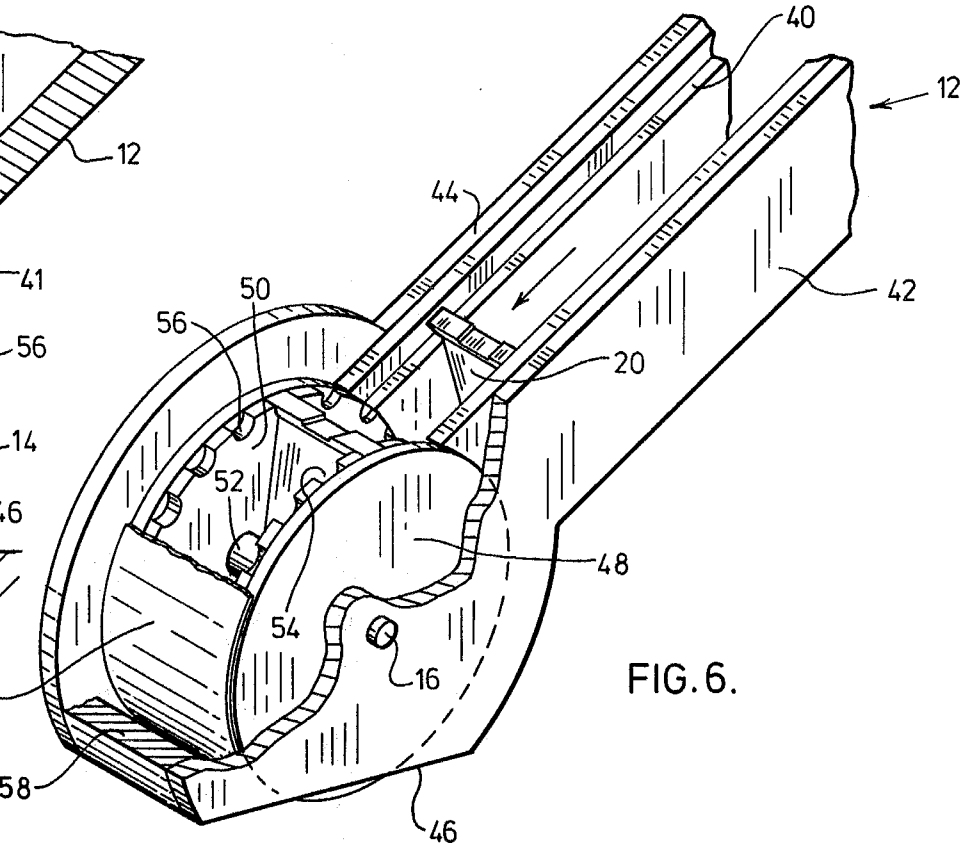
FIG. 6 is a perspective view of the device in accordance with FIG. 1, with parts cut away, generally from above.

As shown in FIGS. 1 and 6, the magazine 12 is an elongated structure having a central open topped channel 38, of width slightly greater than that of the body portion 22 of the playing pieces 20. Ledges 40 are provided, extending the length of the channel, at the top portion thereof, one on either side of the channel 38, and providing upwardly presented support surfaces. Thus, playing elements 20 may be stored in the magazine 12 in inverted disposition, with body portions 22 disposed in the channel 38, and projecting formations 30, 32 suspended by their upper, part circular surfaces resting on the ledges 40. At its end adjacent the wheel housing 14, a stop bar 41 is provided extending across the width of the lower part of the channel, and extending upwardly a short distance to engage the lower edges of pieces 20.

The device 10 is provided with a pair of side frame members 42, 44 which have elongated portions to line the outer sides of the channel 38 and part circular portions integral therewith, to form the housing 14 for the wheel. The bottom portion of the side frame members 42, 44 are cut away at a chord of the circle, at an angle of about 45° to the axis of the magazine 12, to provide a bottom edge 46 of the apparatus 10. The wheel located in the housing 14 is shown in more detail in FIGS. 5, 6, 7 and 8.

Figure 4:
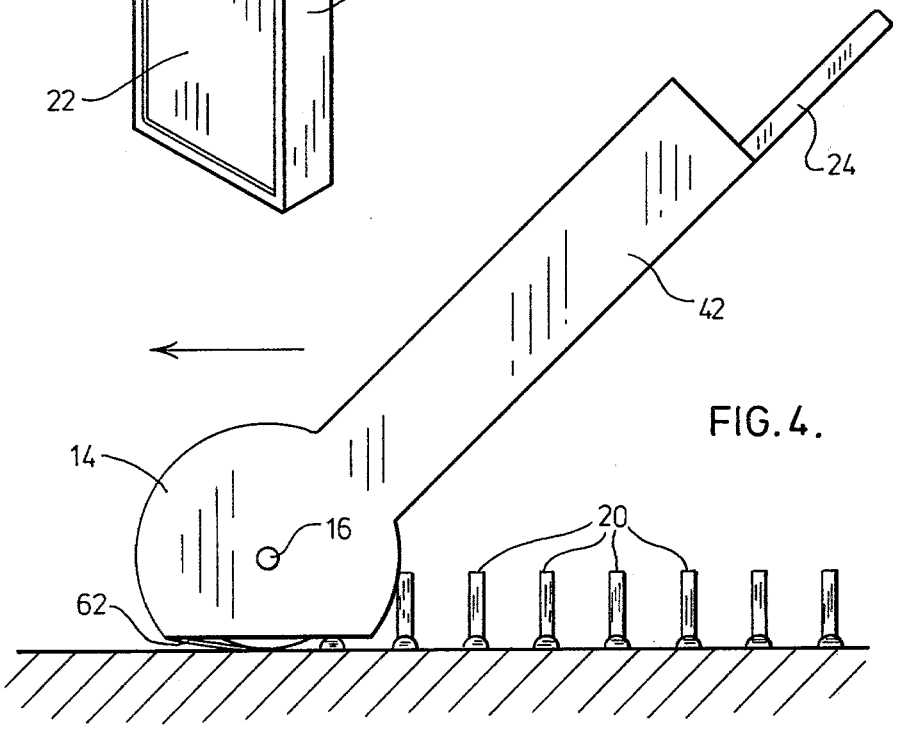
FIG. 4 is a side elevation of the device of FIG. 1, showing the use of the device to erect a series of playing elements.

The wheel essentially comprises first and second discs 48, 50 joined by means of a hub 52 in spaced apart relationship, to form a hollow wheel, the space between the discs corresponding in width to that of the channel 38 of the magazine 12. The radius of the wheel is such that the discs 48, 50 project a small distance below the bottom edge 46 of the apparatus 10. The wheel is pivotally mounted in the side frame members by means of shaft 16 extending through hub 52 of the wheel and through the center of the part circular portion of the side frame members. When the apparatus is supported on a surface so that the bottom edge 46 is substantially parallel to the surface and so that the magazine 12 extends upwardly at an angle of about 45° to the surface, the device 10 effectively rests upon the discs 48, 50 of the wheel, and can be pushed along the surface at that angle, so that the wheel rolls across the surface. This disposition of the apparatus 10 is generally shown in FIG. 4.

As best seen in FIGS. 6 and 7, each disc 48, 50 is provided on its periphery with a series of part circular indentations 54, 56 respectively, pairs of such indentations 54, 56 being in registry with each other in the axial direction of the wheel, and the respective series being equally spaced from one another around the circumference of the wheel. The size of the indentations 54, 56 is arranged so that they can receive therein the projecting formations 30, 32 of a playing piece 20, so that the bottom surface 34 of the playing piece 20 is substantially flush with the circumferential edge of each of the discs 48, 50. The shape of the indentations 54, 56 is generally part circular, so as to accommodate the shape of the upper surfaces of the projecting formations 30, 32 of the playing piece 20 received therein. The radial distance of the wheel, between the hub 52 and the circumference of the discs 48, 50 is sufficient to accommodate the height of a playing piece 20, suspended in the indentations 54, 56 and extending towards the hub, without the top edge of the playing piece 20 touching the surface of the hub 52.

The housing 14 for the wheel includes a part circular, circumferentially extending spacer 58 extending around the outer circumference from a point adjacent to the end of magazine 12, to the front edge of the bottom surface 46 of the device 20. The inner surface of the spacer 58 carries thereon a part circular liner 60, fixedly secured to the spacer 58, but disposed in close proximity to the outer circumferential surface of the discs 48, 50 of the wheel. The liner 60 extends, axially of the wheel, the full width between the side frame members of the housing 14. The liner 60 does not obstruct rotation of the wheel within the housing 14, but is close enough to the periphery of the discs that a playing piece held in indentations 54, 56 on the discs will be prevented from removal from these indentations by engagement with the surface of the liner 60. Moreover, the surface of the liner 60 is close enough to the outer edges of the discs 48, 50 that playing pieces held in the indentations 54, 56 remain radially disposed with respect to the wheel, as they move away from the vertical position as the wheel rotates, by sliding engagement of the bottom surface 34 of the playing piece with the inner surface of the liner 60.

There is further provided, extending rearwardly from the front edge of spacer 58 under the bottom surface 46 of the device, a spring steel strip 62. This can be seen in FIGS. 4, 5, 7 and 8. Strip 62 is narrow in the axial direction of the wheel, and thin, and is designed to have a width less than that of the recess 36 on the bottom surface of the playing piece 20, and a thickness less than the depth of the recess 36. The strip 62 extends rearwardly to a point approximately directly below the center shaft 16 of the discs 48, 50, when the device is supported on a horizontal surface with the bottom surface 46 thereof parallel to the surface. The strip 62 is resilient, so that, under the weight of the device 10 resting on a surface, it will yield upwardly, so as not to interfere with the rolling of the wheel across the surface.

Figure 5:
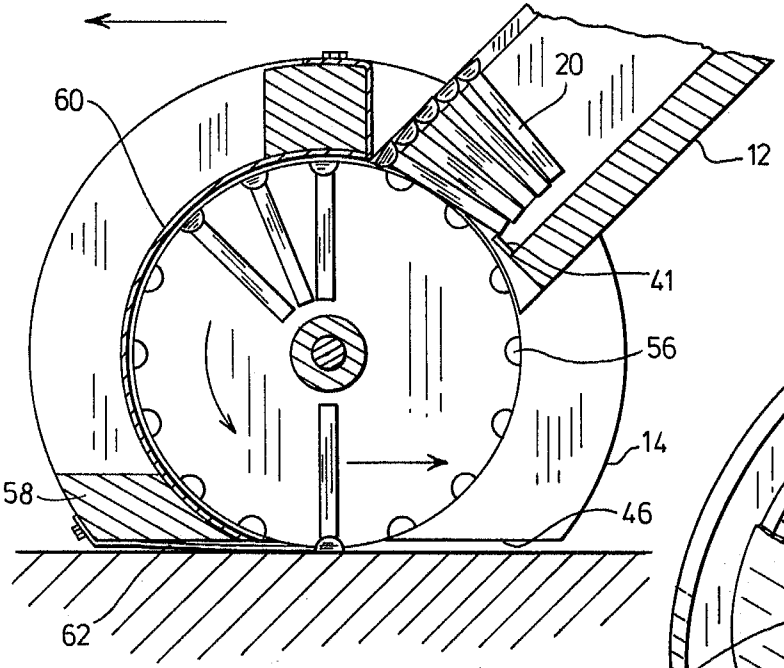
FIG. 5 is a cross sectional view of a detail, taken along the lines V—V of FIG. 1.

In operation, the magazine 12 is first loaded with playing pieces, supported in inverted position on ledges 40. Then the device is placed on a receiving surface, and raised to an angle of about 45°, so that the edges of discs 48, 50 of the wheel rest upon the surface. In doing so, the playing pieces 20 loaded in the magazine 12, slide downwardly towards the wheel. The bottom of the leading playing piece 20 engages stop bar 41, and the top edge of piece 20 engages the periphery of wheel discs 48, 50. The device 10 is now pushed forwardly, in the direction as shown in FIG. 4, so that the discs 48, 50 rotate as the wheel rolls across the surface. The foremost playing piece 20 in the magazine 12 slides in frictional contact with the periphery of the discs 48, 50. As the discs 48, 50 rotate when the device is rolled across the surface, a pair of recesses 54, 56 comes up to the end playing piece 20 in the magazine, receives this projection 30, 32 thereof, and lifts it over stop bar 41, out of the magazine onto the discs 48, 50 in inverted position, suspended in the recesses 54, 56 by means of its projecting formations 30, 32. The next playing piece takes its place agains stop bar 41 and the periphery of the discs, ready to be lifted out onto the wheel by the next pair of recesses 54, 56. As rotation of the discs 48, 50 continues as shown in FIG. 5, the playing pieces 20 held in the recesses 54, 56 move under the liner 60, preventing their removal from the recesses 54, 56 as the discs 48, 50 continue to rotate. The playing pieces 20 held in the disc recesses 54, 56 continue to be disposed radially towards the hub 52, by sliding engagement of the base 34 with the inner surface of the liner 60. They are carried around the wheel until, in their upright position, they are placed upon the receiving surface on which the discs 48, 50 roll. Immediately prior to assuming their upright position, the playing pieces 20 come out of contact with liner 60, since they leave the bottom edge 64 thereof. So that discs 48, 50 can project below bottom surface 46, for rolling across a surface, the liner 60, spacer 58 and other structural parts of the housing 14 must terminate short of vertically upright position of the playing pieces radially disposed on the wheel. At this point, however, the playing pieces continue to be supported in radial disposition on the wheel, by frictional sliding engagement of the resilient strip 62 in the recess 36 of the playing piece. In this manner, the bottom, flat surface 34 of the playing piece 20 is placed on the support surface across which the device 10 is moved, and the playing piece 20 is supported until it is uprightly placed on the surface, by means of the strip 62. Then, further movement of the device withdraws strip 62 from engagement with the recess 36 of the playing piece. As shown in FIG. 7, there is free space left between the side frame members rearwardly of the rearward extremity of strip 62, so that the device 10 as it continues it movement in the direction shown in FIG. 4 leaves the playing pieces in their upright position on the receiving surface, and does not interfere with them or foul them to knock them over as it leaves them.

As the action continues, of course, successive ones of the playing pieces 20 are received in pairs of indentations 54, 56. These are then transported around the wheel to be deposited in their upright, upstanding disposition on the receiving surface. The spacing between the playing pieces 20 after depositing on the support surface is determined by the circumferential spacing between pairs of indentations 54, 56 on the discs 48, 50, and is predetermined and arranged so that, as shown in FIG. 4, the toppling over of the end playing piece towards the next of the serially arranged playing pieces will cause them all to be knocked over in sequence.

It will of course be understood that the above description of a specific embodiment is by way of illustration and example only, and is not to be construed as limiting. The scope of the present invention is limited only by the appended claims.

What we claim is:

1. A device for arranging playing elements in an upstanding disposition on a surface, with predetermined spacings between adjacent ones of said playing elements, said device comprising:

a playing element storage means in the form of an open channel having suspension means for receiving and suspending therein a plurality of playing elements in inverted disposition and in substantial alignment with one another;

a rotatable member disposed adjacent to the storage means and rotatable with respect thereto, the rotatable member being adapted to roll across said surface, and having the form of a centrally journalled wheel structure comprising a wheel housing fixedly secured secured to the storage means and two parallel spaced apart circular discs, of substantially the same radius and mounted for rotation relative to the storage channel, about their common center axis;

said wheel housing further including a liner structure extending around a part of the circumference of the discs and in close proximity to the edges thereof;

playing piece receiving means adapted to receive a playing piece from the storage means in response to rotation of the rotatable member with respect to the storage means, and release the playing piece in upstanding disposition on the surface as a result of rolling the rotatable member across said surface, said playing piece receiving means comprising suspending formations in the form of indentations at the peripheral edges of said discs, said indentations being provided in axially registered pairs, one on each disc, adapted to receive therein lateral, non-circular cross-sectioned projections of one end of a body portion of a playing piece, so as to suspend the playing piece between the discs;

said liner structure being disposed sufficiently closely to the peripheral edge of the discs to prevent substantial angular movement of the projections of the playing piece received in said indentations, relative to the discs as the discs rotate.

2. The device according to claim 1 wherein the playing element storage means feeds the playing elements into engagement with the indentations on the wheel under gravity.

3. The device of claim 2 further including resilient support means attached to the wheel housing at the lower surface thereof, adapted to support the playing pieces received in the indentations of the discs as the discs rotate to bring said playing piece out of the proximity of the liner structure.

* * * * *